US005871047A

United States Patent [19]

Spath et al.

[11] Patent Number: 5,871,047

[45] Date of Patent: Feb. 16, 1999

[54] METHOD FOR DETERMINING WELL PRODUCTIVITY USING AUTOMATIC DOWNTIME DATA

[75] Inventors: Jeff Spath, Richmond; Joe M. Mach, Houston, both of Tex.

[73] Assignee: Schlumberger Technology Corporation, Houston, Tex.

[21] Appl. No.: 909,558

[22] Filed: Aug. 12, 1997

Related U.S. Application Data

[60] Provisional application No. 60/023,961 Aug. 14, 1996.

[51] Int. Cl. [6] ..... E21B 47/00

[52] U.S. Cl. ..... 166/250.01; 166/250.02

[58] Field of Search ..... 166/250.01, 252.6, 166/250.02, 305.1

[56] References Cited

U.S. PATENT DOCUMENTS

| | | | |
|---|---|---|---|
| 4,507,055 | 3/1985 | Fair et al. | 417/12 |
| 5,547,029 | 8/1996 | Rubbo et al. | 166/375 |
| 5,699,246 | 12/1997 | Plasek et al. | 364/422 |

OTHER PUBLICATIONS

L. G. Alexander, "Determination of the Gas–Free Liquid Level and the Annular Gas Flow Rate For a Pumping Well", Apr.–Jun., 1976, The Journal of Canadian Petroleum, pp. 66–70.

James N. McCoy, "Analyzing well performance X", Apr.–Jun., 1978, The Journal of Canadian Petroleum, pp. 80–91.

E. R. Brownscombe, "Afterflows and Buildup Interpretation on Pumping Wells", Feb, 1982, Society of Petroleum Engineers, pp. 397–405.

*Primary Examiner*—Frank Tsay

*Attorney, Agent, or Firm*—John J. Ryberg; Brigitte L. Jeffery

[57] ABSTRACT

A method is presented to estimate the productivity index, PI, and the well condition, s, of a pumping well utilizing the knowledge of pump runtime versus downtime. Runtime and downtime may be constantly and automatically recorded and transmitted to a central location. A model runtime is computed assuming the two unknowns, PI and s. The model is then compared with the actual runtime data. A nonlinear optimization technique is used to search for the unknown parameters such that the differences between the measured data and the numerically simulated data are minimized in a least-squares fashion. The proposed estimation procedure is an economical and accurate method for monitoring the behavior of a well resevoir system during runtime.

10 Claims, 2 Drawing Sheets

METHOD FOR DETERMINING WELL PRODUCTIVITY USING AUTOMATIC DOWNTIME DATA

CROSS-REFERENCES

This present application claims the benefit of U.S. Provisional application Ser. No. 60/023961 filed Aug. 14, 1996.

BACKGROUND OF THE INVENTION

This invention relates to a method for analyzing the performance of a production well. In particular, the invention relates to a method for determining well productivity and skin damage utilizing pump runtime and downtime data.

Pumping wells are generally older wells with declining production. They are prime candidates for estimation of skin damage, fracture length, reservoir pressure, effective permeability, and other diagnostic information provided by pressure buildup curves. However, the necessity of removing the rods and pumps to place the conventional pressure gauge downhole and then measure pressure versus time, is an expensive process and rarely performed on a low producing well.

For the foregoing reasons, there is a need for a method which estimates well productivity during production.

SUMMARY OF THE INVENTION

The above disadvantage of the prior art is overcome by a method for determining the productivity index, PI, and the well condition, s, of a producing well utilizing pumping data. Model database points are generated to simulate runtime and downtime during production of a well. The model database points are computed assuming initial values of the productivity index and skin. The actual runtime and downtime is constantly and automatically recorded in a database. The model is then compared, in a least squares sense, with the actual runtime data. The values of the productivity index and skin are updated and this process is continued until the model matches the actual data.

BRIEF DESCRIPTION OF THE DRAWINGS

The advantages of the present invention will become apparent from the following description of the accompanying drawings. It is to be understood that the drawings are to be used for the purpose of illustration only, and not as a definition of the invention.

In the drawings.

DETAILED DESCRIPTION OF THE PREFERRED EMBODIMENT

Figure 1:
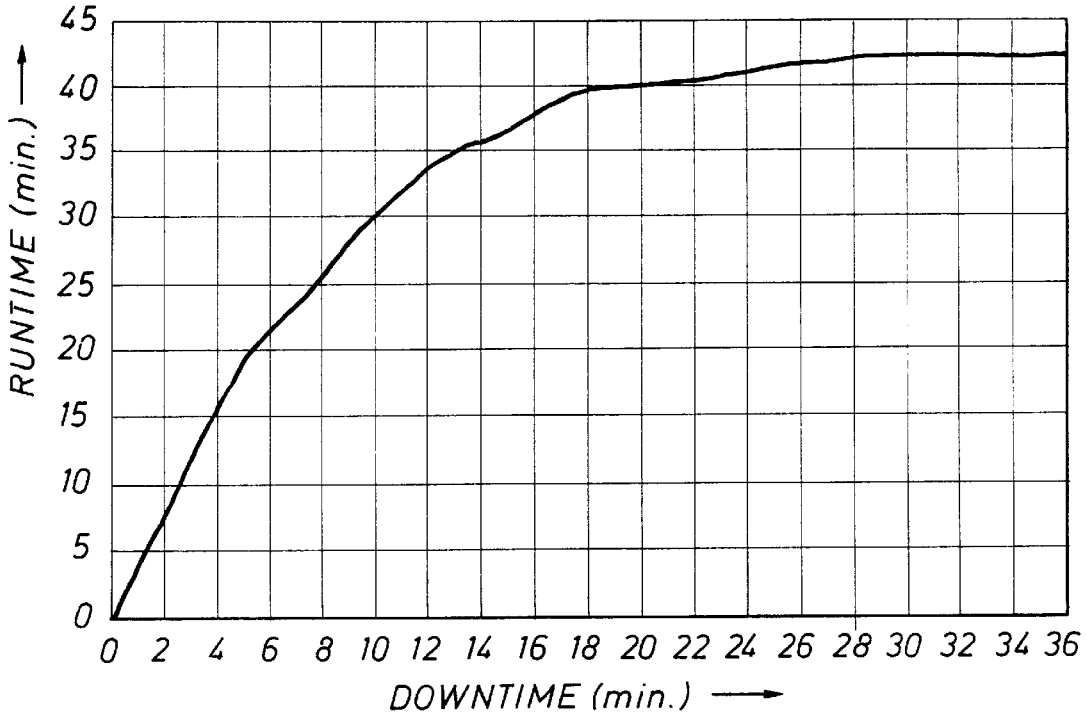
FIG 1 illustrates a plot of pump runtime versus downtime for a producing well.

FIG. 1 illustrates a plot of pump runtime versus downtime for a producing well. In the subject invention, well productivity is determined without removing the rods and pumps in a production well. Actual runtime and downtime data is constantly and automatically recorded in a database. A model runtime is computed assuming initial values of the productivity index and skin. The model is then compared, in a least squares sense, with the actual runtime data. The values of the productivity index and skin are updated and this process is continued until the model matches the actual data.

In computing the model data, the runtime required to pump the fluid level completely off, assuming the outflow, $q_{out}$, is constant, may be defined by the following equation:

$$RT = \frac{q_{in-DT}DT}{q_{out} - q_{in-RT}} \tag{1}$$

and, $$q_{in} = \frac{PI}{p_D}\,(\bar{p}_r - p_{wf}), \tag{2}$$

where RT is the runtime, DT is the downtime, $q_{in}$ is the amount of fluid which accumulates during runtime and downtime, $\bar{p}_r$ is the average reservoir pressure, and $P_{wf}$ is the flowing bottom-hole pressure. The productivity index is defined as follows:

$$PI = \frac{kh}{141.2\mu\beta}\ . \tag{3}$$

If the well is in the center of a closed circle, the dimensionless pressure is defined as:

$$p_D = \ln\left(\frac{r_e}{r_w}\right) - 0.75 + s, \tag{4}$$

where $r_e$ is the external boundary radius, $r_w$ is the well radius, and s is the skin factor. The method of the subject invention may be extended to wells having a different geometry by substitution of the appropriate $P_D$ in Eq. (4).

To generate a model of downtime data, initial values for the productivity index and skin are selected then $q_{in-DT}$ is determined over a period of time. At DT=0, the well is completely pumped off, the fluid height is zero, and the flowing bottom-hole pressure is equal to the sum of the casing pressure and the pressure due to the gas column. Therefore, the following relationship is defined:

$$q_{in-DT}(0) = \frac{PI}{p_D}\,(\bar{p}_r - p_c). \tag{5}$$

Figure 2:
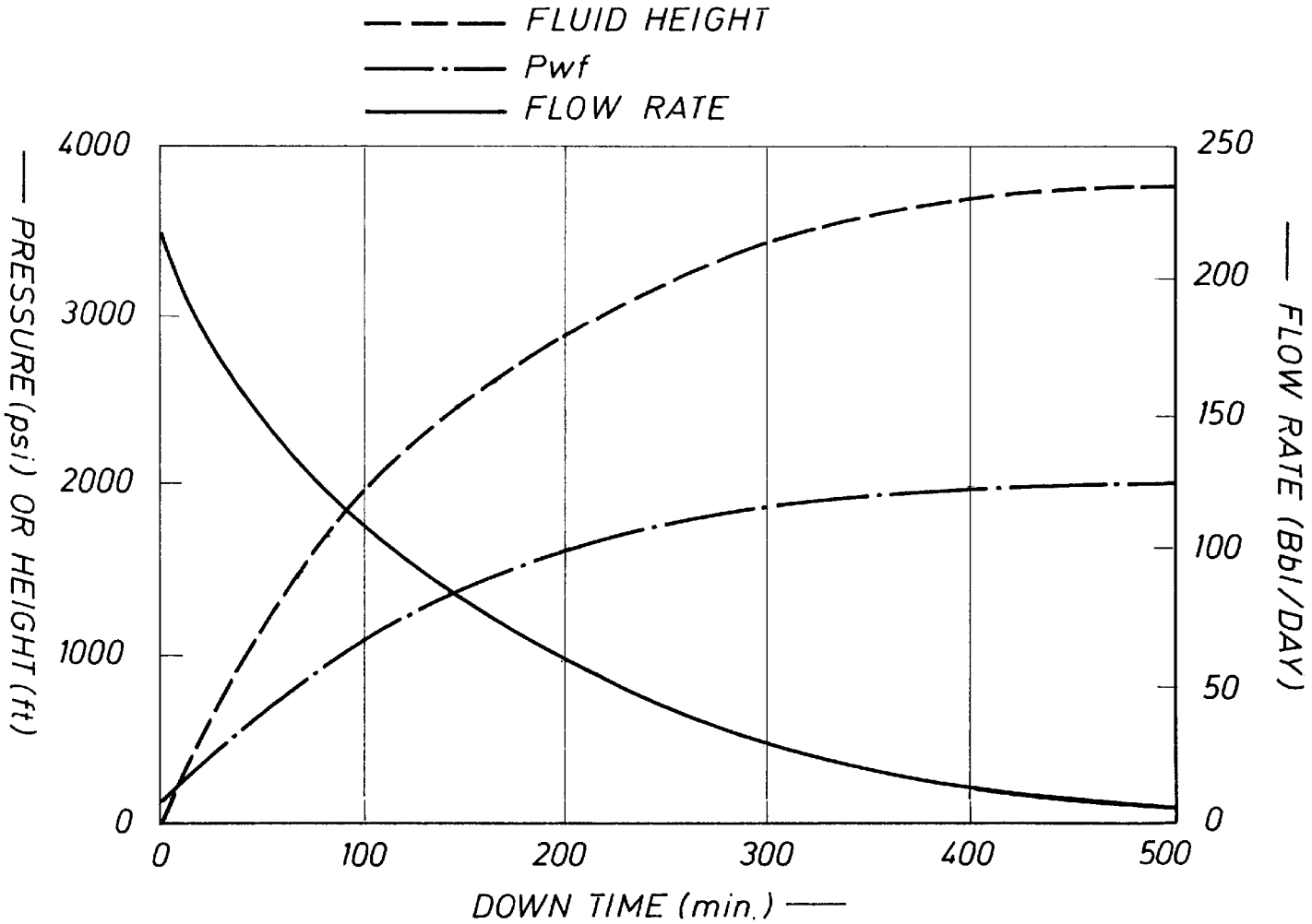
FIG. 2 graphically illustrates the relationship between the downtime and $q_{in-DT}$; and, FIG. 3 depicts an inflow performance relationship diagram.

At $DT = i$, $$q_{in-DT}(i) = \frac{PI}{p_D}\,[\bar{p}_r - (p_c + 0.433\gamma_L h_f(i-1))], \tag{6}$$

where $\gamma_L$ is the combined specific gravity of the liquid and $h_f$ (i−1) is the height of the fluid column due to the (i−1) value of $q_{in-DT}$. FIG. 2 graphically illustrates the relationship between the downtime and $q_{in-DT}$.

To generate a model of runtime data, the initial values for the productivity index and skin used to determine $q_{in-DT}$ are also used to determine $q_{in-RT}$ over a period of time. Computation of the inflow rate must consider the changing fluid height due to the fluid withdrawal and the inflow rate, that is, $$\frac{dh_f}{dRT} = q_{in-RT} - q_{out}. \tag{7}$$

At RT=0, because the well is static, the only change in pressure is due to the fluid withdrawal which is given by the following equation:

$$\Delta p(\mathbf{0}) = 0.433\gamma_L \Delta h(\mathbf{0}) \tag{8}$$

At RT=i, $$q_{in-RT}(i) = \frac{PI}{p_D}\left[\bar{p}_r - \sum_{i=0}^{i-1} \Delta p(i)\right] \tag{9}$$

The modeled values derived from Eqs. (6) and (9) are then used to solve for values of the runtime in accordance with Eq. (1). The model is then compared with the actual runtime data. A nonlinear technique is preferably used to invert and solve for the productivity index, PI, and the well condition, s, such that the differences between the measured data and the numerically simulated data are minimized utilizing a suitable minimization algorithm which includes, but is not limited to, the modified Newton-Raphson or conjugate gradient approach.

Assumptions based on linearity of the final portion of the runtime versus downtime data plot can constrain the matching problem by providing an initial estimate of the productivity index. When dRT/dDT=0, $q_{in}$=0 and the fluid height is equal to the kill height, $h_k$, defined by the following equation:

$$h_k = \frac{\bar{p}_r}{0.433\gamma_L} \quad (10)$$

Figure 3:
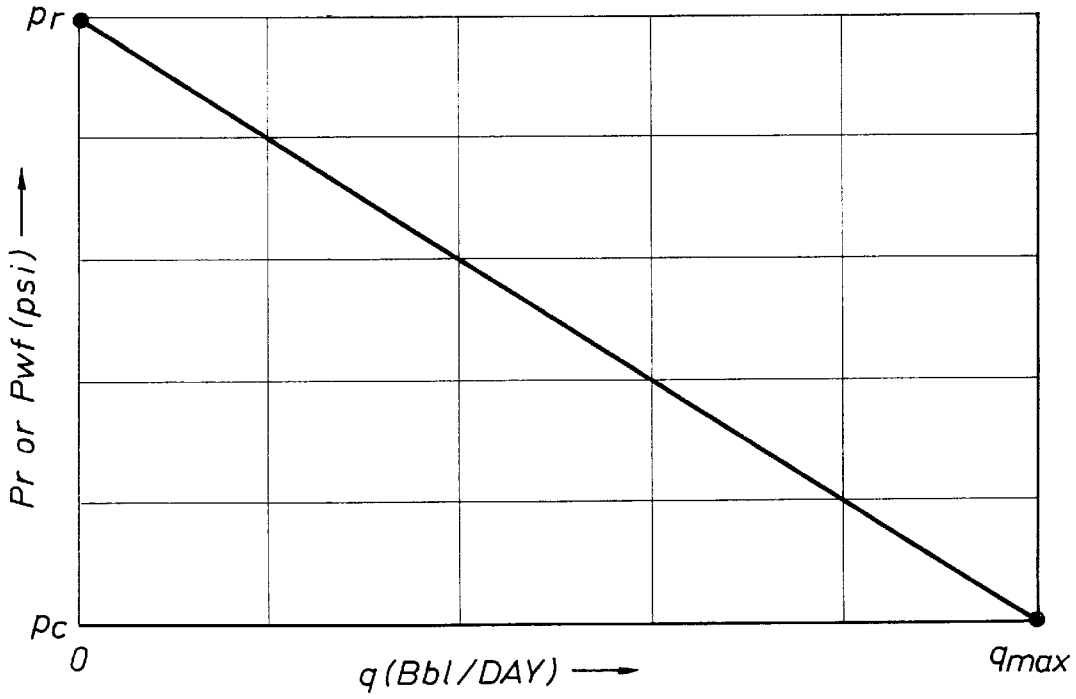

Using the plot shown in FIG. 1, the time, $t_k$, to achieve the kill height occurs at a downtime of 26 minutes. The average flowrate from 0 to 26 minutes is defined by:

$$\bar{q}_{in-DT}(0\text{–}26\text{min}) = \frac{1440 h_k V_A}{t_k}, \quad (11)$$

where $V_A$ is the annular volume in bbl/ft. Further, $$\bar{q}_{in} = \frac{PI}{p_D}(\bar{p}_r - \bar{p}_{wf}), \quad (12)$$

where is the average flowing pressure from 0 to 26 minutes. At DT=$t_k$, $q_{in}$=0, and $P_{wf}=\bar{p}_r$. At DT=0, $q_{in}=q_{max}$ and $P_{wf}=P_c$. Assuming a linear relationship between q and $P_{wf}$, an inflow performance relationship curve is generated as illustrated in FIG. 3. To constrain the matching problem, an initial productivity index may be estimated from 1/slope of the line in FIG. 3.

The foregoing description of the preferred and alternate embodiments of the present invention have been presented for purposes of illustration and description. It is not intended to be exhaustive or limit the invention to the precise form disclosed. Obviously, many modifications and variations will be apparent to those skilled in the art. The embodiments were chosen and described in order to best explain the principles of the invention and its practical application thereby enabling others skilled in the art to understand the invention for various embodiments and with various modifications as are suited to the particular use contemplated. It is intended that the scope of the invention be defined by the accompanying claims and their equivalents.

What I claim is:

1. A method for estimating the productivity index during oil production in an earth formation traversed by a wellbore, comprising the steps of:

a) generating modeled database points to simulate an operational response from the producing well;

b) obtaining measured database points from the producing well;

c) determining the productivity index of the producing well using a non-linear regression technique based on measured and modeled database points.

2. The method of claim 1 wherein step (a) further comprises the step of selecting an initial value of the productivity index and the well condition, s.

3. The method of claim 2 wherein step (a) further comprises the step of determining the amount of fluid which accumulates in the wellbore during downtime.

4. The method of claim 3 wherein step (a) further comprises the step of determining the amount of fluid which accumulates in the wellbore during runtime.

5. The method of claim 2 further comprising the step of deriving an inflow performance relationship curve and determining an initial estimate of the productivity index based on the curve.

6. A method for estimating the well condition, s, during oil production in an earth formation traversed by a wellbore, comprising the steps of:

a) generating modeled database points to simulate a measurement response from the producing well;

b) obtaining measured database points from the producing well;

c) determining the well condition, s, of the producing well using a non-linear regression technique based on measured and modeled database points.

7. The method of claim 6 wherein step (a) further comprises the step of selecting an initial value of the productivity index and the well condition, s.

8. The method of claim 7 wherein step (a) further comprises the step of determining the amount of fluid which accumulates in the wellbore during downtime.

9. The method of claim 8 wherein step (a) further comprises the step of determining the amount of fluid which accumulates in the wellbore during runtime.

10. The method of claim 7 further comprising the step of deriving an inflow performance relationship curve and determining an initial estimate of the productivity index based on the curve.

* * * * *